US012673812B2

(12) United States Patent
Alié et al.

(10) Patent No.: US 12,673,812 B2
(45) Date of Patent: Jul. 7, 2026

(54) MEDICAMENT DISPENSER

(71) Applicant: Sanofi, Paris (FR)

(72) Inventors: Jean Alié, Paris (FR); Stéphane Gilles, Paris (FR); Frédéric Gouges, Paris (FR); Jean-Yves Lanne, Paris (FR)

(73) Assignee: Sanofi, Paris (FR)

( * ) Notice: Subject to any disclaimer, the term of this patent is extended or adjusted under 35 U.S.C. 154(b) by 148 days.

(21) Appl. No.: 18/708,159

(22) PCT Filed: Nov. 9, 2022

(86) PCT No.: PCT/EP2022/081235
§ 371 (c)(1),
(2) Date: May 7, 2024

(87) PCT Pub. No.: WO2023/083851
PCT Pub. Date: May 19, 2023

(65) Prior Publication Data

US 2024/0425266 A1 Dec. 26, 2024

(30) Foreign Application Priority Data

Nov. 10, 2021 (EP) ..... 21315239

(51) Int. Cl.
*B65D 83/04* (2006.01)

(52) U.S. Cl.
CPC .... *B65D 83/0427* (2013.01); *B65D 2583/049* (2013.01)

(58) Field of Classification Search
CPC ..... B65D 83/0427; B65D 2583/049
See application file for complete search history.

(56) References Cited

U.S. PATENT DOCUMENTS 3,874,564 A 4/1975 Huneke
4,460,106 A 7/1984 Moulding, Jr. et al.
(Continued)

FOREIGN PATENT DOCUMENTS

CA 2130881 A1 2/1996
CN 108698749 A 10/2018
(Continued)

OTHER PUBLICATIONS

International Preliminary Report on Patentability in International Appln. No. PCT/EP2022/081235, mailed on May 23, 2024, 7 pages.
(Continued)

*Primary Examiner* — Gene O Crawford
*Assistant Examiner* — Ayodeji T Ojofeitimi
(74) *Attorney, Agent, or Firm* — Fish & Richardson P.C.

(57) ABSTRACT

A dispenser for attachment to a medicament container is configured to convey a dose of medicament. The dispenser includes an outer part having a dose dispensing chamber, a circumferential wall and a dose dispensing outlet in the circumferential wall. An inner part is rotatably disposed within the outer part and has a dosing aperture, a circumferential wall, and a dose dispensing outlet in the circumferential wall. The outer part is rotatable relative to the inner part between a dosing position, in which the dosing aperture communicates with the dose dispensing chamber to allow a dose to pass through the dosing aperture and into the dose dispensing chamber, and a dispensing position, in which the dose dispensing chamber, the outlet in the circumferential wall, and the outlet in the circumferential wall align to define a dose dispensing path out of the dispenser for delivery of the dose to a user.

18 Claims, 6 Drawing Sheets

(56) References Cited

U.S. PATENT DOCUMENTS

| | | | | |
|---|---|---|---|---|
| 4,611,727 | A | 9/1986 | Graff | |
| 5,791,515 | A | 8/1998 | Khan et al. | |
| 5,947,329 | A | 9/1999 | Bailey | |
| 6,283,339 | B1 | 9/2001 | Morrow | |
| 6,929,159 | B1 | 8/2005 | Haig | |
| 7,100,797 | B2 | 9/2006 | Kahn et al. | |
| 7,404,500 | B2 | 7/2008 | Marteau et al. | |
| 10,479,588 | B2 * | 11/2019 | Sanders | A61J 1/1412 |
| 11,679,063 | B1 * | 6/2023 | Butaud | A61J 7/0481 221/1 |
| 2011/0011883 | A1 | 1/2011 | Nakkouri | |
| 2013/0116818 | A1 * | 5/2013 | Hamilton | A61J 7/04 221/277 |
| 2015/0021349 | A1 | 1/2015 | Sanders | |
| 2015/0226515 | A1 * | 8/2015 | Tseng | F41B 11/53 221/265 |
| 2015/0342830 | A1 * | 12/2015 | Bujalski | A61J 7/0076 221/3 |
| 2016/0128906 | A1 * | 5/2016 | Baarman | A61J 7/04 221/13 |
| 2016/0145031 | A1 * | 5/2016 | Reinhold | B65D 83/0409 221/22 |
| 2017/0190503 | A1 | 7/2017 | French et al. | |
| 2017/0231871 | A1 * | 8/2017 | Aldasouqi | B65D 83/04 221/203 |
| 2017/0281471 | A1 | 10/2017 | Hamilton | |
| 2019/0142698 | A1 * | 5/2019 | Bukstein | G01F 15/00 221/1 |
| 2020/0130900 | A1 | 4/2020 | Herbert et al. | |

FOREIGN PATENT DOCUMENTS

| | | | |
|---|---|---|---|
| CN | 207932339 | U | 10/2018 |
| CN | 210527366 | U | 5/2020 |
| EP | 2502852 | A1 | 9/2012 |
| WO | WO 2017/003953 | A2 | 1/2017 |
| WO | WO 2023/083851 | A1 | 5/2023 |

OTHER PUBLICATIONS

International Search Report and Written Opinion in International Appln. No. PCT/EP2022/081235, mailed on Feb. 7, 2023, 9 pages.

* cited by examiner

MEDICAMENT DISPENSER

CROSS-REFERENCE TO RELATED APPLICATIONS

The present application is the national stage entry of International Patent Application No. PCT/EP2022/081235, filed on Nov. 9, 2022, and claims priority to Application No. EP 21315239.0, filed on Nov. 10, 2021, the disclosures of which are incorporated herein by reference.

TECHNICAL FIELD

The present disclosure relates to a dispenser for attachment to a medicament container, the dispenser being configured to convey a dose of medicament out of the container in use.

BACKGROUND

Medicament containers are often sealed to preserve their contents. In some cases a medicament container might contain a modified atmosphere, such as an inert gas. This can be the case when the medicament is in a powder or solid form, such as in bottles of tablets, pills or capsules and where the medicament is sensitive to oxidation or humidity. It is desirable to be able to deliver medicament from bottles having a modified atmosphere without significant dilution of the atmosphere due to repeated opening and closing.

SUMMARY

According to embodiments of the disclosure, there is provided a dispenser for attachment to a medicament container, the dispenser being configured to convey a dose of medicament out of the container in use, the dispenser comprising:

an outer part having a dose dispensing chamber, a circumferential wall and a dose dispensing outlet in the circumferential wall;

an inner part rotatably disposed within the outer part, the inner part having a dosing aperture, a circumferential wall and a dose dispensing outlet in the circumferential wall;

wherein the outer part is rotatable relative to the inner part between a dosing position, in which the dosing aperture communicates with the dose dispensing chamber to allow a dose to pass through the dosing aperture and into the dose dispensing chamber, and a dispensing position, in which the dose dispensing chamber, the outlet in the circumferential wall of the inner part and the outlet in the circumferential wall of the outer part align to define a dose dispensing path out of the dispenser for delivery of the dose to a user.

Therefore, the disclosure provides a simply constructed dispenser having an airlock function to prevent an exchange of gases in and out of a container to which the dispenser is attached.

The inner and outer parts may be concentrically arranged about a common longitudinal axis; and wherein the longitudinal axis is an axis of rotation of the outer part, when the outer part is rotated relative to the inner part.

The circumferential wall of the inner part may be disposed between the dose dispensing chamber and the circumferential wall of the outer part; and wherein, when the inner part and outer part are arranged in the dosing position, the circumferential wall of the inner part closes off the outlet in the circumferential wall of the outer part.

Therefore, in any position of the outer part relative to the inner part, there is no direct path through the dispenser for the exchange of gases.

When the inner and outer parts are arranged in the dose dispensing position, the dosing aperture may be closed off by the outer part.

The outer part may further comprises a channel for conveying the dose from the dose dispensing chamber up to the circumferential wall of the inner part.

The dose dispensing path is straight and unencumbered to allow a dose to be dispensed with minimal manipulation of the bottle.

The inner part may comprise a dividing wall that extends perpendicular to the longitudinal axis to divide an interior of the inner part into upper and lower areas; and wherein the dosing aperture is provided in the dividing wall.

The outer part may comprise a lower wall that extends perpendicular to the longitudinal axis and bounds an interior of the outer part with the circumferential wall; the outer part further comprising a cylindrical protrusion that upstands from the lower wall into the interior of the outer part, wherein the dose receiving chamber is formed as a recess in an upper surface of the cylindrical protrusion.

An outer surface of the cylindrical protrusion may be spaced from an inner surface of the circumferential wall of the outer part to form a channel, the circumferential wall of the inner part being received in said channel.

The upper surface of the cylindrical protrusion of the outer part may abut a lower surface of the dividing wall of the inner part.

An inner surface of the circumferential wall of the inner part may abut the outer surface of the cylindrical protrusion of the outer part.

An outer surface of the circumferential wall of the inner part may abut the inner surface of the circumferential wall of the outer part.

Therefore, the inner part is closely fitted within the outer part.

The inner part and outer part may form an airtight seal at abutting surfaces.

The dose dispensing path may lie in a dispensing plane, the dispensing plane being substantially perpendicular to the axis of rotation of the outer part.

The inner part may be configured for fixed attachment to the medicament container so that, when the dispenser is attached to the medicament container, the outer part is rotatable relative to the inner part and the medicament container.

The inner part may be configured for a screw or bayonet style attachment to the medicament container.

The dispenser may be configured for use with tablets or capsules.

The inner part may comprise an edge that depends from the dividing wall and is configured to pierce a seal of a medicament container.

According to embodiments of the disclosure, there is also provided a method of using the dispenser of any of claims 1 to 14 with a medicament bottle containing medicament, the method comprising:

attaching the dispenser to the bottle by fixing the inner part of the dispenser to a neck portion of the bottle;

setting the inner and outer parts of the dispenser in the dosing position;

inverting the bottle so that the medicament collects in the neck portion of the bottle above the dispenser, with a single dose of medicament disposed in the dosing aperture;

rotating the outer part relative to the inner part into the dispensing position, causing the dose to pass through the aperture and into the dispensing chamber; and tilting the bottle to cause the dose to fall out of the dispensing chamber, along the dose dispensing path.

The dispenser may comprise an edge that depends from the inner part and is configured to pierce a seal of the medicament bottle, and wherein attaching the dispenser to the bottle may comprise piercing the seal as the dispenser is attached to the bottle.

Attaching the dispenser to the bottle may comprise forming an air tight seal between the dispenser and the bottle.

The dispenser may be attached to the bottle by threaded engagement of the inner part of the dispenser with a correspondingly threaded portion of the neck of the bottle.

According to embodiments of the disclosure, there is provided a dispenser for attachment to a medicament container, the dispenser being configured to convey a dose of medicament out of the container in use, the dispenser comprising:

a housing that defines a dose dispensing channel; and a revolving dispenser disposed within the channel and configured to form an airtight seal between inlet and outlet portions of the channel;

wherein the revolving dispenser is provided with a compartment for holding a dose of medicament, the revolving dispenser being configured to rotate to convey the compartment between the inlet and outlet portions of the channel.

According to embodiments of the disclosure, there is also provided a method of using the dispenser of claim 17 with a medicament bottle containing medicament, the method comprising: attaching the dispenser to the bottle by fixing the inlet portion of the dispenser onto a neck portion of the bottle;

setting the revolving dispenser in a dosing position;

inverting the bottle so that the medicament collects in the neck portion of the bottle above the dispenser, with a single dose disposed in the compartment of the revolving dispenser;

rotating the revolving dispenser into the dispensing position, causing the dose to fall out of the compartment for collection by a user.

The dispenser may be configured to pierce a seal of the medicament bottle, and wherein attaching the dispenser to the bottle may comprise piercing the seal as the dispenser is attached to the bottle.

Attaching the dispenser to the bottle may comprise forming an airtight seal between the dispenser and the bottle.

According to embodiments of the disclosure, there is provided a medicament container containing a medicament comprising a dispenser according to any of the statements above.

DETAILED DESCRIPTION

Figure 1:
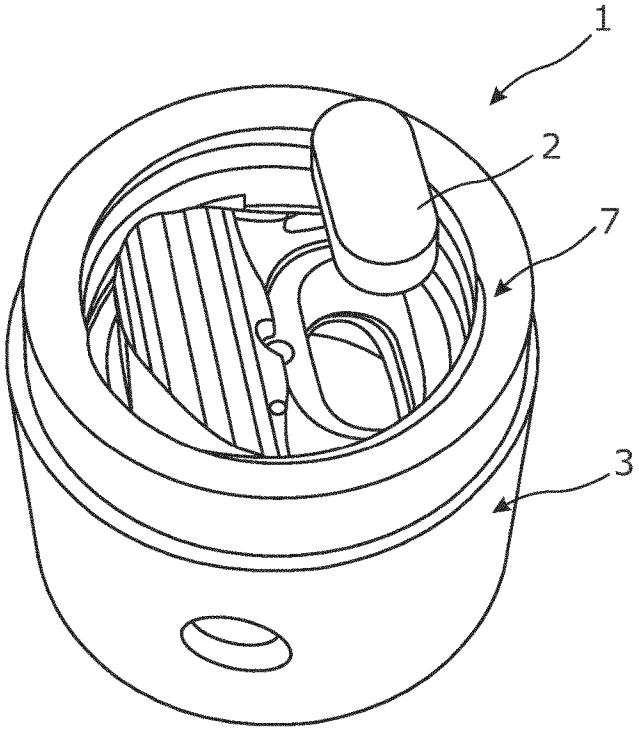
FIG. 1 shows a dispenser for attachment to a medicament container.
Figure 8:
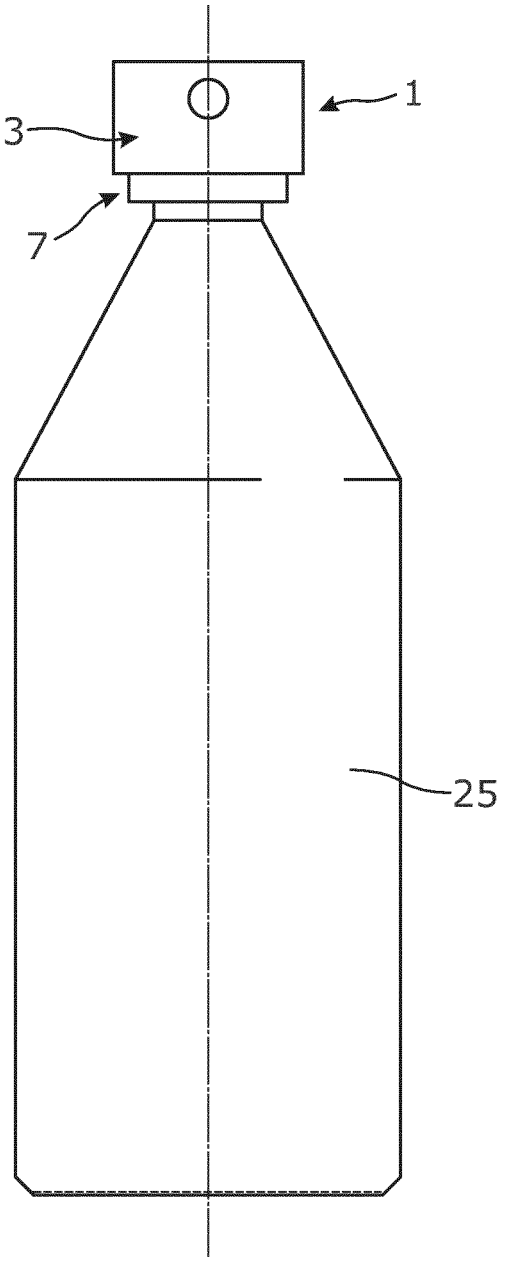
FIG. 8 shows the dispenser attached to a medicament container.

FIG. 1 shows a dispenser 1 for attachment to medicament container 25 according to an embodiment of the disclosure. The dispenser 1 comprises an inner part 7 and an outer part 3. The inner part 7 is configured for fixed attachment to the medicament container 25, as shown in FIG. 8. The outer part 3 is configured for rotation relative to the inner part 7 to dispense a dose 2 of medicament from the container 25.

Figure 2:
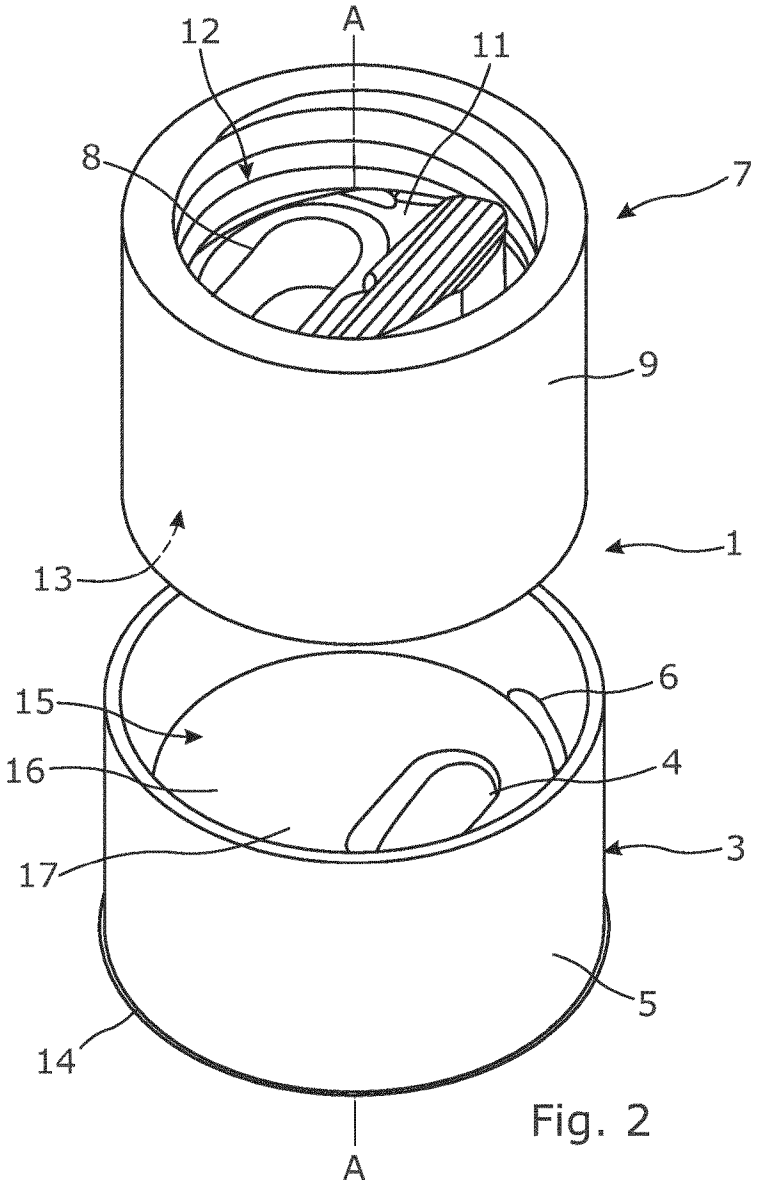
FIG. 2 is an exploded view of the dispenser.
Figure 4:
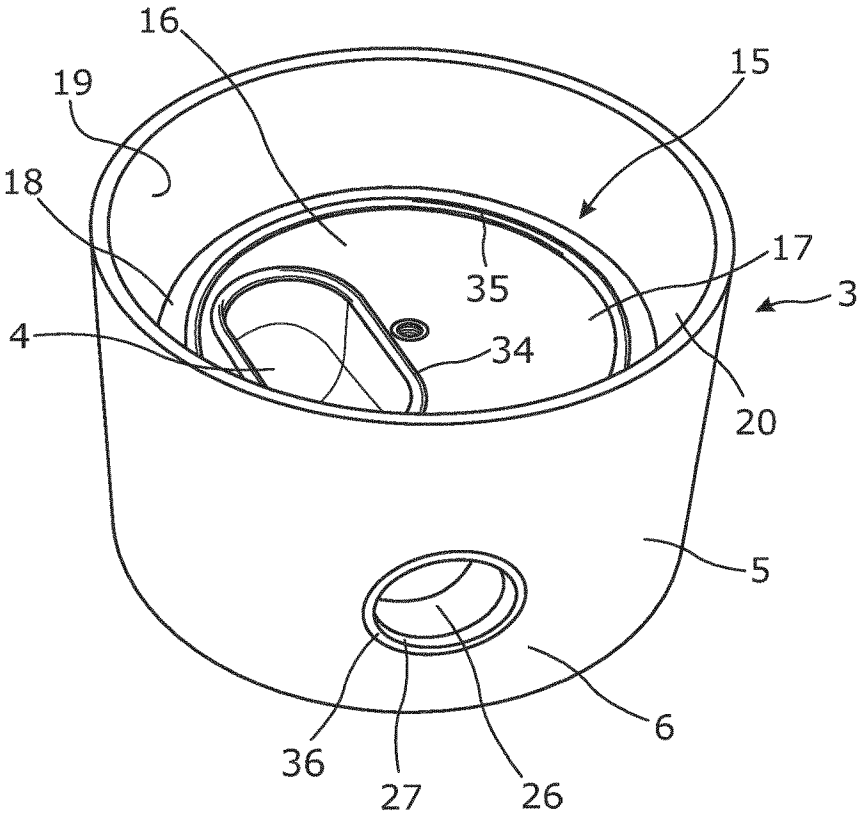
FIG. 4 shows an outer part of the dispenser.
Figure 3:
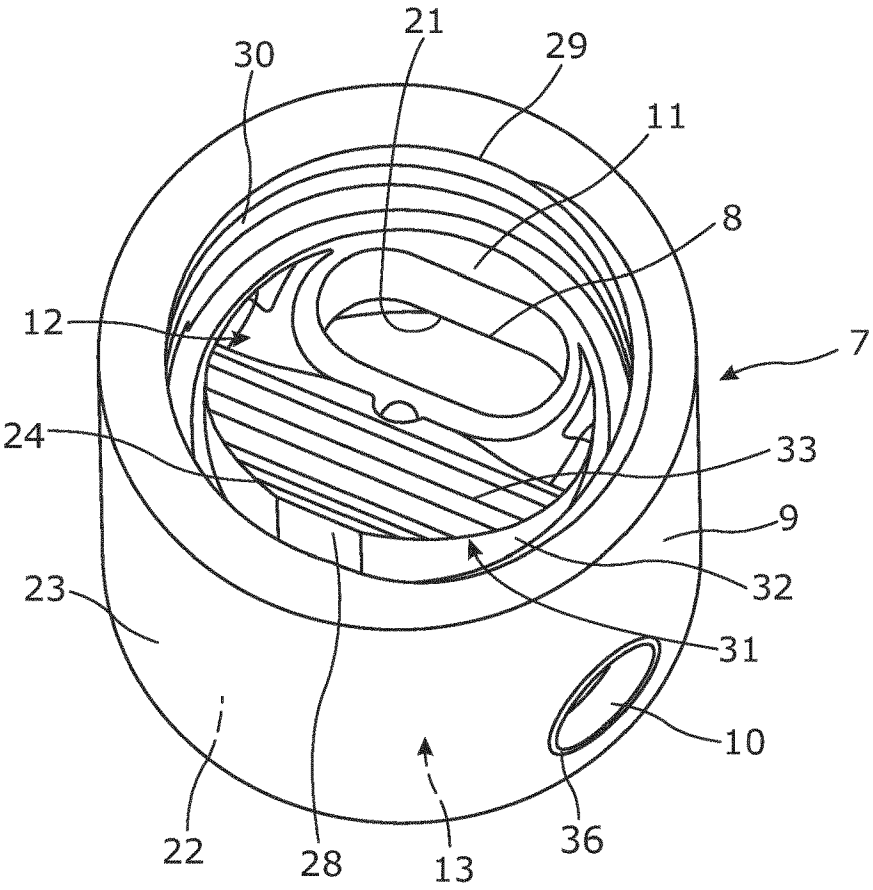
FIG. 3 shows an inner part of the dispenser.

The detail and function of the inner part 7 and outer parts 3 are explained with reference to FIGS. 2 to 4. The inner and outer parts 7, 3 are generally cylindrical and each comprise a circumferential wall 9, 5. The inner and outer parts 7, 3 are concentrically arranged about a common longitudinal axis A-A, with the inner part 7 partially received within the outer part 3. When rotated relative to the inner part 7, the outer part 3 rotates around the common axis A-A. The inner and outer parts 7, 3 are in close fitting arrangement so that an inner surface 19 of the circumferential wall 5 of the outer part 3 slides across an outer surface 23 of the circumferential wall 9 of the inner part 7 as the outer part 3 is rotated.

The inner part 7 comprises a dividing wall 11. The dividing wall 11 extends within the circumferential wall 9, perpendicular to the longitudinal axis A-A. The dividing wall 11 separates an interior of the inner part 7 into upper and lower parts 12, 13.

When the inner part 7 is fixedly attached to the medicament container 25, the upper interior 12 forms an extension of the interior of the container 25. A dosing aperture 8 is provided into the dividing wall 11 to selectively communicate the upper interior 12 of the inner part 7 with a dispensing chamber 4 of the outer part 3.

The outer part 3 comprises a lower wall 14 that extends across one end of the circumferential wall 5 so that the outer part 3 is cup shaped.

A cylindrical protrusion 16 upstands from the lower wall 14 into an interior 15 of the outer part 3. An outer surface 18 of the cylindrical protrusion 16 is spaced from the inner surface 19 of the circumferential wall 5 of the outer part 3 to form a channel 20 in between the two surfaces 18, 19. The circumferential wall 9 of the inner part 7 is located in the channel 20. The cylindrical protrusion 16 extends into the lower interior part 13 of the inner part 7. An upper surface 17 of the cylindrical protrusion 16 abuts a lower surface 21 of the dividing wall 11 of inner part 7 so that, when the outer part 3 is rotated relative to the inner part 7, the upper surface 17 of the cylindrical protrusion 16 slides across the lower surface 21 of the dividing wall 11.

The dispensing chamber 4 is formed as a receptacle in the upper surface 17 of the cylindrical protrusion 16. When the outer part 3 is in a dosing position, the dosing aperture 8 in the dividing wall 11 is aligned with the dose dispensing chamber 4 to allow a dose 2 to pass through the dosing aperture 8 and into the dose dispensing chamber 4. The outer part 3 further comprises a channel 26 that leads from the dose dispensing chamber 4 to an opening 27 in the outer surface 18 of the cylindrical protrusion 16.

Figure 5:
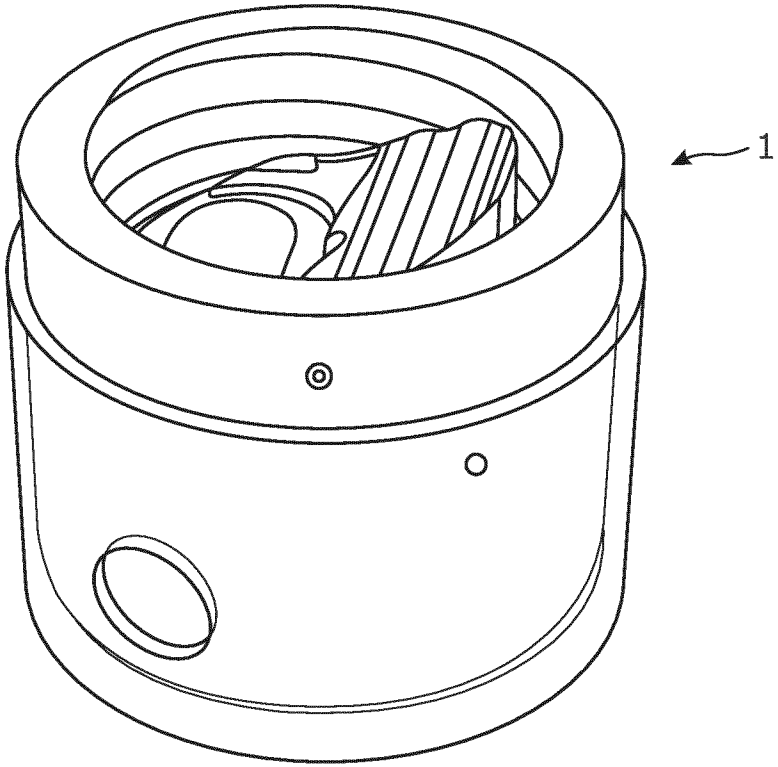
FIG. 5 shows the dispenser in a dosing position.

The circumferential wall 9 of the inner part 7 and the circumferential wall 5 of the outer part 3 each comprise a dose dispensing outlet 10, 6. The dose dispensing outlet 10, 6 is an aperture to allow the dose 2 to pass through the circumferential wall 9, 5. The dose dispensing outlet 10, 6 in the circumferential wall 5 of the outer part 3 is disposed directly opposite the channel 26 opening 27. With the outer part 3 in the dosing position, the outlets 10, 6 in the inner and outer parts 7, 3 are not aligned and the circumferential wall 9 of the inner part 7 blocks off communication between the channel opening 27 and the dispensing outlet 6 of the outer part 3, as shown in FIG. 5.

Figure 6:
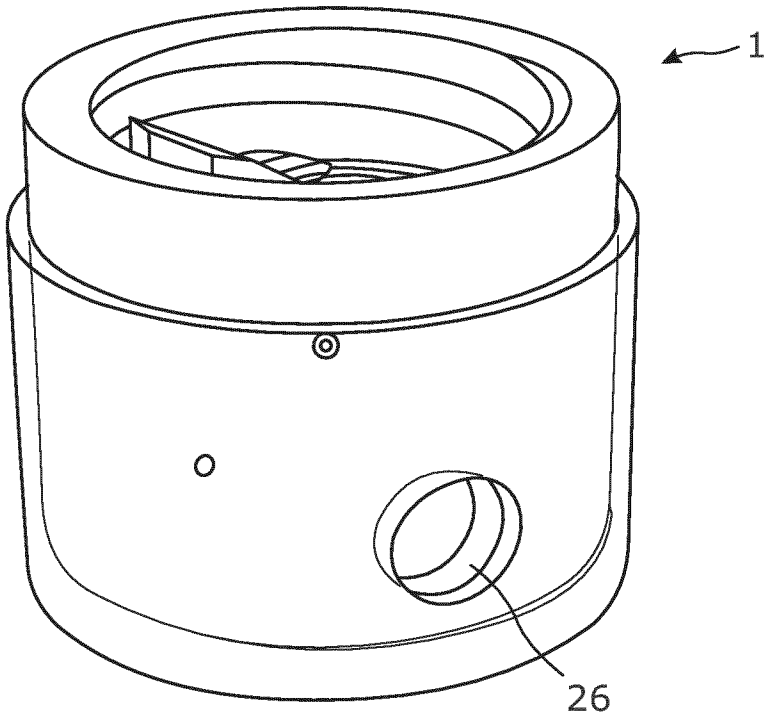
FIG. 6 shows the dispenser in a dispensing position.

In use, the outer part 3 is rotated relative to the inner part 7 between the dosing position and a dispensing position. The dispensing position is shown in FIG. 6. In the dispensing position, the dose dispensing outlets 10, 6 of the inner and outer parts 7, 3 are aligned so that a dose 2 may pass from the dose dispensing chamber 4 along the channel 26 and through the dispensing outlets 10, 6 of the inner and outer parts 7, 3 for delivery to the user. It shall be appreciated that in FIGS. 5 and 6, the outer part 7 is shown in transparent form to better illustrate the difference between the dosing and dispensing positions.

When in the dispensing position, the aperture 8 in the dividing wall 11 of the inner part 7 is out of alignment with the dose dispensing chamber 4 and is instead blocked off by the upper surface 17 of the cylindrical protrusion 16 of the outer part 3. Also, when in the dosing position, the outlets 10, 6 in the inner and outer parts 7, 3 are not aligned and the circumferential wall 9 of the inner part 7 blocks off communication between the channel opening 27 and the dispensing outlet 6 of the outer part 3. Therefore, in any position of the outer part 3 relative to the inner part 7, there is no direct path through the dispenser 1 for the exchange of gases. Because the inner part 7 is closely fitted within the outer part 3, the inner part 7 and outer part 3 form an airtight seal at abutting surfaces 19, 23, 17, 21. In particular, when the inner and outer parts 7, 3 are in the dispensing position, gas is prevented from passing through the dosing aperture 8 in the dividing wall 11 by the upper surface 17 of the cylindrical protrusion 16; when the inner and outer parts 7, 3 are in the dosing position, gas is prevented from passing through the outlet 6 in the outer part 3 by the circumferential wall 9 of the inner part 7. Therefore, when the dispenser 1 is attached to a medicament container 25, the dispenser 1 prevents the ingress of air into the medicament container 25, or the egress of modified atmosphere out of the medicament container 25. By preventing such an exchange of gases, dilution of the atmosphere inside the medicament container 25 is significantly reduced or eliminated each time a dose 2 is dispensed. In addition, the outer surface 18 of the cylindrical protrusion 16 may abut the inner surface 22 of the circumferential wall 9 to further improve the airtight sealing of the inner and outer parts 7, 3, if required. In the embodiment illustrated by FIGS. 3 and 4, the inner and outer parts 7, 3 are provided with gasket seals 34, 35, 36. First and second gasket seals 34, 35 are provided in the upper surface 17 of the cylindrical protrusion 16 to seal the upper surface 17 to the lower surface 21 of the dividing wall 11. The first gasket seal 34 is provided around the edge of the dosing aperture 8, while the second gasket seal 35 is provided offset from the edge of the upper surface 17 of the cylindrical protrusion 16. Third gasket seal 36 is provided in the outer surface 23 of the circumferential wall 9 of the inner part 7 to seal the outer surface 23 to the inner surface 19 of the circumferential wall 5 of the outer part 3. The third gasket seal 36 is provided around the dose dispensing outlet 10. It will be appreciated that any or all of the gasket seals 34, 35, 36 are optional and that an airtight seal may be formed by any of abutting surfaces 19, 23, 18, 22, 17, 21 without the need for gasket seals if relatively tight manufacturing tolerances are applied. Advantageously, the gasket seals 34, 35, 36 ensure that an airtight seal is formed between abutting surfaces 19, 23, 17, 21 of the inner and outer parts 7, 3 even allowing for relatively large manufacturing tolerances. Therefore, the gasket seals 34, 35, 36 may reduce the cost of manufacturing the dispenser 1.

The dispenser further comprises a seal breaker 28 disposed on the inner part 7. The seal breaker 28 is configured to break the seal of a medicament container 25 when the dispenser 1 is attached to the container 25. Medicament containers typically comprise a bottle 25 having a neck portion and a paper, polymer or aluminium foil membrane sealed across an opening of the neck portion. With conventional dispensers, the seal is broken and the dispenser attached. However, this results in the atmosphere within the medicament container being diluted by gas exchange. The dispenser 1 of the present disclosure is configured to break the seal as it is attached to the bottle 25 to minimise or eliminate any escape of gas from within the bottle 25 or ingress of air into the bottle 25. The inner part 7 of the dispenser 1 further comprises a female thread 29 on an inner surface 30 of the circumferential wall 9 of the upper part 12. The female thread 29 is configured to engage a corresponding male thread provided on an outer surface of the neck portion of the bottle 25. Therefore, the inner part 7 can be screwed onto the neck portion of the bottle 25 by engagement of the male and female threads for fixed attachment thereto. The seal breaker 28 comprises an edge 24. The edge 24 pierces the membrane of the bottle 25 as the dispenser 1 and the bottle 25 are screwed together. Due to rotation of the dispenser relative to the bottle 25, the edge 24 cuts a circular opening in the membrane.

The edge 24 is an edge of a protrusion 31 that upstands from the dividing wall 11. The protrusion 31 comprises first 32 and second surfaces 33: the first surface 32 upstands perpendicular to the dividing wall 11, while the second surface 33 upstands obliquely from the dividing wall 11 to meet the first surface 32 at the edge 24. The first surface 32 comprises a semi-circular cross section, giving the edge a curve. The first surface 32 is spaced from the circumferential wall 9 to allow space for the neck of the bottle 25. Advantageously, the second surface 33 forms a ramp 33 that, in use, guides a dose 2 to the dosing aperture 8.

Although in the illustrated embodiments, the dispenser 1 is provided with a female thread 29, it will be appreciated that other airtight attachment mechanisms may be employed, such as, for example, a bayonet fitting.

In the illustrated embodiment the dose 2 of medicament is shown as a tablet 2, however the dispenser 1 may be used to dispense other forms of solid dose 2, or even a powdered medicament, in the same way. It will also be appreciated that the term 'medicament' is intended to cover nutraceuticals or supplements as well as more traditional medicines.

Figure 7:
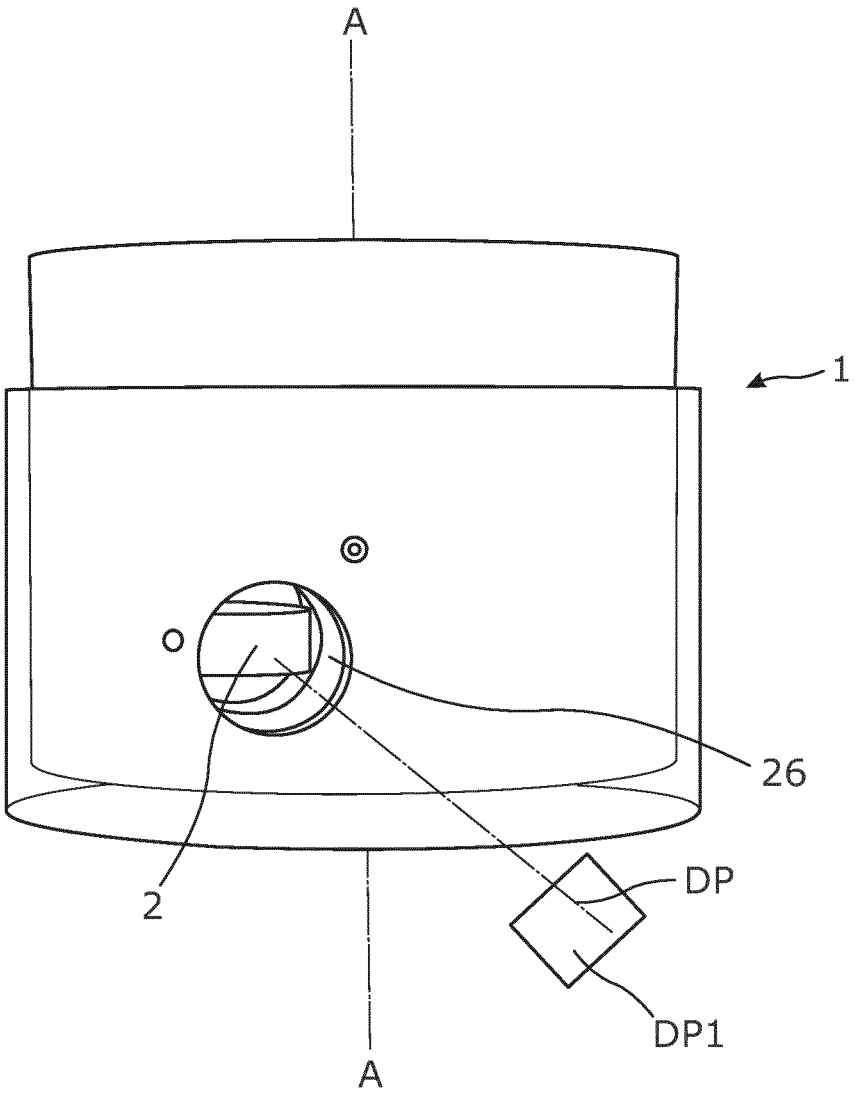
FIG. 7 shows the dispenser in the dispensing position.

When the inner and outer parts 7, 3 are arranged in the dispensing position, the dispensing chamber 4, channel 26 and outlets 10, 6 align to define a dose dispensing path DP, as shown in FIG. 7. The dose dispensing path DP is straight and unencumbered to allow the dose 2 to be dispensed with minimal manipulation of the bottle 25. Preferably, the dose dispending path DP lies in a plane DP' substantially perpendicular to the common axis A-A. Therefore, the dose 2 may be dispensed simply by tilting the bottle 25 slightly. Where an oblong tablet 2 is dispensed as shown in the illustrated figures, the tablet 2 is dispensed along the dose dispensing path DP parallel to the tablet's 2 longitudinal axis.

In one example, the dispenser 1 is used with a medicament bottle 25 containing tablets 2, according to the following steps:

1. The dispenser 1 is attached to the bottle 25 by screwing the inner part 7 of the dispenser 1 onto a correspondingly threaded neck portion of the bottle 25.
2. The inner and outer parts 7, 3 of the dispenser 1 are set in the dosing position.
3. The bottle 25 is inverted so that the tablets 2 collect in the neck portion of the bottle 25 above the dispenser 1, with a single tablet 2 disposed in the dosing aperture 8.
4. The outer part 3 is then rotated relative to the inner part 7 into the dispensing position, causing the tablet 2 to pass through the aperture 8 and into the dispensing chamber 4.
5. The bottle 25 is tilted to cause the tablet 2 to fall out of the dispensing chamber 4, along the channel 26 and out through the outlets 10, 6 in circumferential walls of the inner and outer 7, 3 parts to deliver the tablet 2 to the user.

Steps 2 to 5 can be repeated until all of the tablets 2 within the bottle 25 have been dispensed. Once all of the tablets 2 have been dispensed, the dispenser can be removed for re-use with another bottle 25.

The dispenser 1 may be further fitted with a counter to indicate the number of tablets 2 that have been dispensed. For example, an electronic counter (not shown) may be provided having a digital display in the circumferential wall 5 of the outer part 3. Each time the outer part 3 is rotated relative to the inner part 7 between the dosing and dispensed position, the counter may increase its count by 1 and display a number accordingly. Therefore, the user the user is assisted in keeping track of the number of tablets 2 dispensed. In order to keep count, the electronic counter is provided with a source of power (e.g. a 2032 battery or similar) which can be installed in the lower wall 14 of the outer part 3. Conductive strips can be inlaid into the circumferential wall 5 of the outer part 3 to provide an electrical connection to the counter. The electrical contacts may have terminals in the inner surface 19 of the circumferential wall 5 of the outer part 3. The electrical terminals may then be connected by a conductive strip inlaid into the outer surface of the circumferential wall 9 of the inner part 7 when the outer and inner parts 3, 7 are in the dispensing position. This connection completes a circuit which sends a signal to the counter to record that an additional tablet 2 has been dispensed.

The dispenser 1 described with reference to FIGS. 1 to 7 may be manufactured using an additive layer technique, more commonly known as 3D printing. For example, the inner and outer parts 7, 3 of the dispenser 1 may be 3D printed from any suitable material and then assembled by push fitting the inner part 7 into the outer part 3. The inner and outer parts 7, 3 may therefore have a monolithic construction.

Figure 9:
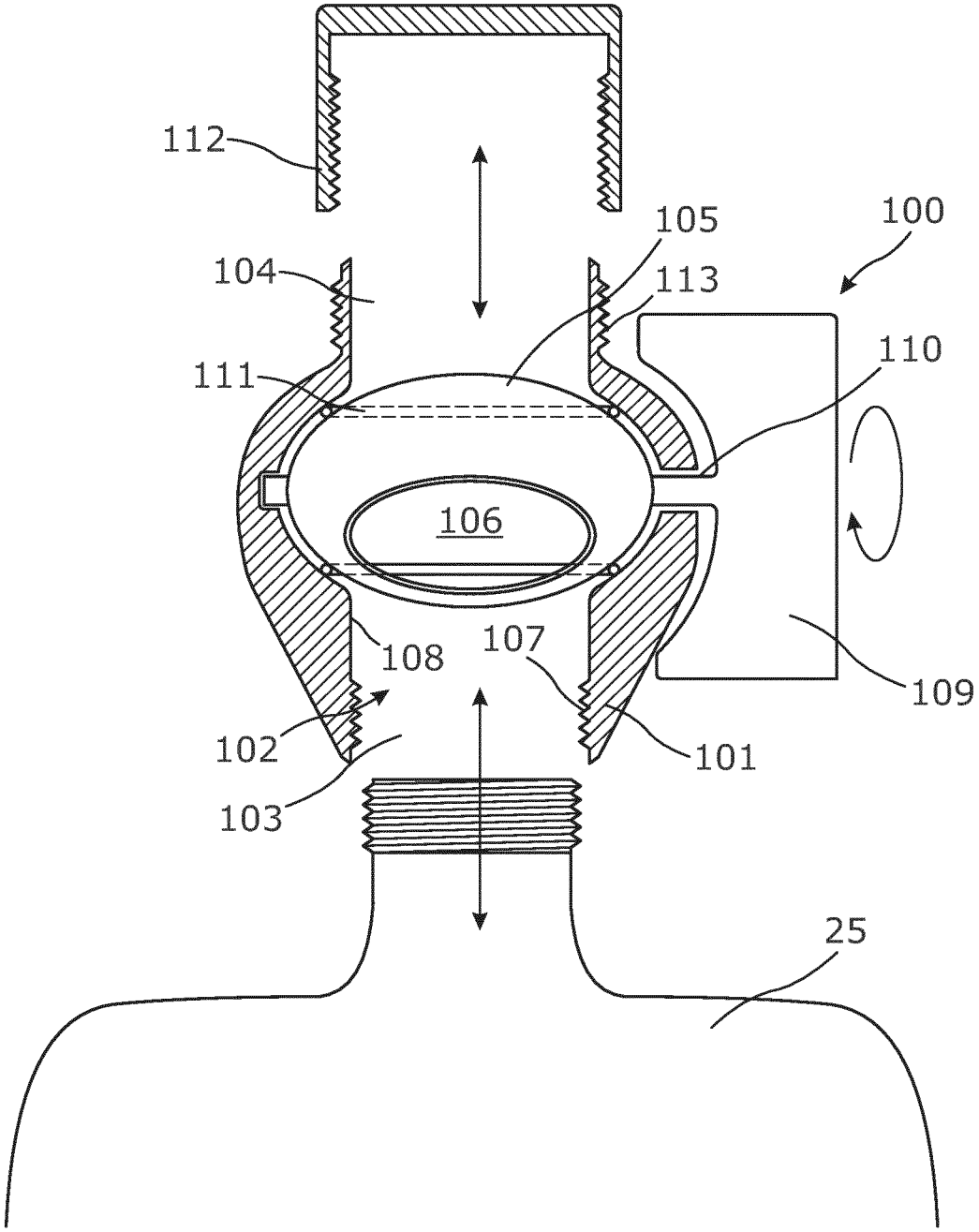
FIG. 9 shows another dispenser for attachment to a medicament container.

In another embodiment shown in FIG. 9, a dispenser 100 for attachment to a medicament container 25 is provided. The dispenser 100 is configured to convey a dose 2 of medicament out of the container 25 in use and comprises a housing 101 that defines a dose dispensing channel 102. The dose dispensing channel 102 has an inlet portion 103 and an outlet portion 104 that is divided by a revolving dispenser 105 that forms an airtight seal between the inlet and the outlet portions 103, 104. The revolving dispenser 105 is provided with a compartment 106 for holding a dose 2 of medicament and is configured to rotate to convey the compartment 106 between the inlet and outlet portions 103. 104 of the channel 102.

The inlet portion 103 comprises a female thread 107 on an inner surface 108 of the inlet portion 103 for attachment to a medicament bottle 25 comprising a corresponding male thread on a neck portion of the bottle 25. With the dispenser 100 attached to a bottle 25 in this way, the inlet portion 103 forms an extension to the bottle 25, which is sealed by the revolving dispenser 105 in the outlet channel 102.

The revolving dispenser 105 is operated by a knob 109 disposed outside the housing 101. An axle 110 connects the knob 109 to the revolving dispenser 105. Therefore, rotation of the knob 109 causes rotation of the revolving dispenser 105.

A longitudinal axis of the dispenser is defined parallel to the dispensing channel. Therefore, when the dispenser is attached to a bottle 25, the bottle 25 and the dispenser share a common longitudinal axis. The revolving dispenser and knob are configured to rotate about an axis perpendicular to the longitudinal axis.

The revolving dispenser 105 is rotatable between a dosing position and a dispensing position. In the dosing position the compartment 106 is arranged facing the inlet portion 103 of the dispensing channel 102 for receiving a dose 2 of medicament; while in the dispensing position, the compartment 106 is arranged facing the outlet portion 104 for delivery of the dose 2 to the user.

The revolving dispenser 105 may be spherical and have a smooth, curved outer surface. Ring seals 111 may be disposed between the housing 101 and the curved outer surface of the revolving dispenser 105 so as to seal the revolving dispenser 105 in the outlet channel 102, irrespective of its orientation between the dosing and dispensing positions.

The dispenser 100 is optionally provided with a cap 112. The cap 112 is a threaded cup shaped cover that is attachable to an externally threaded part 113 of the outlet portion 104 of the dispensing channel 102. Therefore, when a dose 2 of medicament is dispensed it falls into the cap 112. The cap 112 can then be removed and passed to a patient without the user of the dispenser 100 having to directly handle the medicament.

In one example, the dispenser 100 is used with a medicament bottle 25 containing tablets 2, according to the following steps:

1. The dispenser 100 is attached to the bottle 25 by screwing the inlet portion of the dispenser 100 onto a correspondingly threaded neck portion of the bottle 25.
2. The revolving dispenser 105 is set in the dosing position.
3. The bottle 25 is inverted so that the tablets 2 collect in the neck portion of the bottle 25 above the dispenser 100, with a single tablet 2 disposed in the compartment 106 of the revolving dispenser 105.
4. The knob 109 is then rotated into the dispensing position, causing the tablet 2 to fall out of the compartment 106 and into the cap 112.
5. The cap 112 may then be unscrewed from the dispenser 100 to retrieve the tablet 2.

Steps 2 to 5 can be repeated until all of the tablets 2 within the bottle 25 have been dispensed. Once all of the tablets 2 have been dispensed, the dispenser 100 can be removed for re-use with another bottle 25.

The invention claimed is:

1. A dispenser for attachment to a medicament container, the dispenser being configured to convey a dose of medicament out of the medicament container in use, the dispenser comprising:

an outer part having a dose dispensing chamber, a circumferential wall, and a dose dispensing outlet in the circumferential wall; and an inner part rotatably disposed within the outer part, the inner part having a dosing aperture, a circumferential wall, and a dose dispensing outlet in the circumferential wall of the inner part;

wherein the outer part is rotatable relative to the inner part between a dosing position, in which the dosing aperture communicates with the dose dispensing chamber to allow a dose to pass through the dosing aperture and into the dose dispensing chamber, and a dispensing position, in which the dose dispensing chamber, the dose dispensing outlet in the circumferential wall of the inner part, and the dose dispensing outlet in the circumferential wall of the outer part align to define a dose dispensing path out of the dispenser for delivery of the dose to a user.

2. The dispenser of claim 1, wherein the inner and outer parts are concentrically arranged about a common longitudinal axis; and wherein the longitudinal axis is an axis of rotation of the outer part when the outer part is rotated relative to the inner part.

3. The dispenser of claim 1, wherein the circumferential wall of the inner part is disposed between the dose dispensing chamber and the circumferential wall of the outer part; and wherein, when the inner part and outer part are arranged in the dosing position, the circumferential wall of the inner part closes off the dose dispensing outlet in the circumferential wall of the outer part.

4. The dispenser of claim 1, wherein, when the inner and outer parts are arranged in the dispensing position, the dosing aperture is closed off by the outer part.

5. The dispenser of claim 1, wherein the outer part comprises a channel for conveying the dose from the dose dispensing chamber to the circumferential wall of the inner part.

6. The dispenser of claim 2, wherein the inner part comprises a dividing wall that extends perpendicular to the longitudinal axis to divide an interior of the inner part into upper and lower areas; and wherein the dosing aperture is provided in the dividing wall.

7. The dispenser of claim 6, wherein the outer part comprises a lower wall that extends perpendicular to the longitudinal axis and bounds an interior of the outer part with the circumferential wall;

wherein the outer part comprises a cylindrical protrusion that upstands from the lower wall into the interior of the outer part;

wherein the dose dispensing chamber is formed as a recess in an upper surface of the cylindrical protrusion.

8. The dispenser of claim 7, wherein an outer surface of the cylindrical protrusion is spaced from an inner surface of the circumferential wall of the outer part to form a channel;

wherein the circumferential wall of the inner part is received in the channel.

9. The dispenser of claim 8, wherein the upper surface of the cylindrical protrusion of the outer part abuts a lower surface of the dividing wall of the inner part.

10. The dispenser of claim 9, comprising at least one of (i), (ii), or (iii);

(i) wherein an inner surface of the circumferential wall of the inner part abuts the outer surface of the cylindrical protrusion of the outer part; (ii) wherein an outer surface of the circumferential wall of the inner part abuts the inner surface of the circumferential wall of the outer part; (iii) wherein the inner part and the outer part form an airtight seal at abutting surfaces.

11. The dispenser of claim 2, wherein the dose dispensing path lies in a dispensing plane that is substantially perpendicular to the axis of rotation of the outer part.

12. The dispenser of claim 1, wherein the inner part is configured for fixed attachment to the medicament container so that when the dispenser is attached to the medicament container, the outer part is rotatable relative to the inner part and the medicament container.

13. The dispenser of claim 11, wherein the inner part is configured for a screw or bayonet style attachment to the medicament container.

14. The dispenser of claim 1, wherein the dispenser is configured for use with tablets or capsules.

15. The dispenser of claim 6, wherein the inner part comprises an edge that depends from the dividing wall and is configured to pierce a seal of a medicament container.

16. A method of using a dispenser with a medicament bottle containing a medicament, the method comprising:

attaching the dispenser to the medicament bottle by fixing an inner part of the dispenser to a neck portion of the medicament bottle, the dispenser comprising an outer part having a dose dispensing chamber, a circumferential wall, and an outlet in the circumferential wall, the inner part rotatably disposed within the outer part, the inner part having a dosing aperture, a circumferential wall, and an outlet in the circumferential wall of the inner part;

setting the inner and outer parts of the dispenser in a dosing position in which the dosing aperture communicates with the dose dispensing chamber;

inverting the medicament bottle so that the medicament collects in the neck portion of the medicament bottle above the dispenser with a single dose of medicament disposed in the dosing aperture;

rotating the outer part relative to the inner part into a dispensing position in which the dose dispensing chamber, the outlet in the circumferential wall of the inner part, and the outlet in the circumferential wall of the outer part align to define a dose dispensing path, to cause the single dose to pass through the dosing aperture and into the dose dispensing chamber; and tilting the medicament bottle to cause the single dose to fall out of the dose dispensing chamber along the dose dispensing path.

17. The method of claim 16, wherein attaching the dispenser to the medicament bottle comprises forming an airtight seal between the dispenser and the medicament bottle.

18. A medicament container comprising:

a medicament; and a dispenser attachable to the medicament container and configured to convey a dose of medicament out of the medicament container in use, the dispenser comprising:

an outer part having a dose dispensing chamber, a circumferential wall, and a dose dispensing outlet in the circumferential wall; and an inner part rotatably disposed within the outer part, the inner part having a dosing aperture, a circumferential wall, and a dose dispensing outlet in the circumferential wall of the inner part;

wherein the outer part is rotatable relative to the inner part between a dosing position, in which the dosing aperture communicates with the dose dispensing chamber to allow a dose to pass through the dosing aperture and into the dose dispensing chamber, and a dispensing position, in which the dose dispensing chamber, the dose dispensing outlet in the circumferential wall of the inner part, and the dose dispensing outlet in the circumferential wall of the outer part align to define a dose dispensing path out of the dispenser for delivery of the dose to a user.

* * * * *